US009053690B2

(12) United States Patent
Thee et al.

(10) Patent No.: US 9,053,690 B2
(45) Date of Patent: Jun. 9, 2015

(54) STRING INSTRUMENT, SYSTEM AND METHOD OF USING SAME

(76) Inventors: Ben Zion Thee, Efrat (IL); Shimon Mizrahi, Bet Shemesh (IL)

( * ) Notice: Subject to any disclaimer, the term of this patent is extended or adjusted under 35 U.S.C. 154(b) by 0 days.

(21) Appl. No.: 14/232,260

(22) PCT Filed: Jul. 12, 2012

(86) PCT No.: PCT/IL2012/000279
§ 371 (c)(1),
(2), (4) Date: Apr. 9, 2014

(87) PCT Pub. No.: WO2013/008232
PCT Pub. Date: Jan. 17, 2013

(65) Prior Publication Data

US 2014/0290467 A1 Oct. 2, 2014

(30) Foreign Application Priority Data

Jul. 12, 2011 (IL) ..... 214030

(51) Int. Cl.
*G10H 3/00* (2006.01)
*G10H 1/00* (2006.01)
*G10H 1/38* (2006.01)

(52) U.S. Cl.
CPC ..... *G10H 1/0016* (2013.01); *G10H 1/0066* (2013.01); *G10H 1/38* (2013.01); *G10H 2220/301* (2013.01); *G10H 2240/311* (2013.01)

(58) Field of Classification Search
CPC ..... G10H 1/342; G10H 1/0066; G10H 1/38; G10H 2240/311; G10H 1/348; G10H 1/00; G10H 2220/301; G10H 2220/051; G10H 1/06; G10H 1/34; G10H 2220/056; G10H 2220/076; G10H 2220/165; G10H 2220/561; G10H 2240/031; G10H 1/383
See application file for complete search history.

(56) References Cited

U.S. PATENT DOCUMENTS

| | | | | |
|---|---|---|---|---|
| 4,580,478 | A | 4/1986 | Brosh | |
| 6,191,350 | B1 * | 2/2001 | Okulov et al. | 84/646 |
| 2008/0236374 | A1 | 10/2008 | Kramer | |
| 2010/0083807 | A1 * | 4/2010 | Sullivan | 84/315 |

(Continued)

FOREIGN PATENT DOCUMENTS

| | | |
|---|---|---|
| JP | 08-335083 | 12/1996 |
| JP | 1999-121925 A | 4/1999 |

(Continued)

*Primary Examiner* — Marlon Fletcher
(74) *Attorney, Agent, or Firm* — Henry J. Cittone; Cittone & Chinta LLP

(57) ABSTRACT

A string instrument is provided having: a body with a sound hole; a neck extending from the body; a plurality of strings strung over the neck and sound hole; a plurality of frets positioned under the strings along the neck, a plurality of sensors positioned on the neck; and electronic circuitry associated with the sensors; characterized, in that each of the frets comprises separate individual fret sections each mounted over a corresponding sensor, thereby forming separate individual dynamic fret-activated sensors, each individual dynamic fret-activated sensor being positioned correspondingly under one of the plurality of strings. When a chord is played by applying finger pressure on the strings, pressure is applied on the corresponding individual frets activating the individual dynamic fret-activated sensors, which transmit the pressure data representing the played chord, via the electronic circuitry to a processor to produce an audio output comprising the played chord.

13 Claims, 7 Drawing Sheets

(56) References Cited

U.S. PATENT DOCUMENTS

| | | | | |
|---|---|---|---|---|
| 2010/0083808 | A1* | 4/2010 | Sullivan | 84/315 |
| 2010/0234109 | A1* | 9/2010 | Chiu et al. | 463/37 |
| 2011/0175845 | A1 | 7/2011 | Honda | |
| 2011/0218022 | A1* | 9/2011 | Chiu et al. | 463/7 |
| 2012/0036982 | A1* | 2/2012 | Sullivan | 84/724 |
| 2013/0180384 | A1* | 7/2013 | Van Wagoner et al. | 84/485 R |

FOREIGN PATENT DOCUMENTS

| | | | |
|---|---|---|---|
| JP | 2004-177910 | A | 6/2004 |
| WO | 0046785 | A1 | 8/2000 |

* cited by examiner

STRING INSTRUMENT, SYSTEM AND METHOD OF USING SAME

CROSS-REFERENCE TO RELATED APPLICATIONS

This application is the U.S. national stage of PCT International Patent Application No. PCT/IL2012/000279, filed Jul. 12, 2012, which claims priority to Israel Patent Application No. 214030, filed Jul. 12, 2011, the disclosures of each of which are incorporated herein by reference.

OBJECT OF THE INVENTION

The present invention concerns a specially modified string instrument, such as a guitar, which is referred to as a "One Man Band "(OMB), and a system and a method of playing same that enables a guitarist to perform alone for an audience, or play for himself alone for pleasure. The string instrument, such as a guitar, is constructed so that a guitarist can accompany himself not only with chords and solo, with which he is familiar, but also with an automatic accompaniment of harmony for what he is playing. This automatic accompaniment includes drums, bass and other instruments which can create orchestration and musical harmony of an entire orchestra, similar to that which is produced by an organ or synthesizer.

The present invention achieves this without significantly or noticeably altering the shape or weight of the string instrument, or manner of playing. The player does not have to give up what he has learned until now, nor does he have to learn a new method of playing, but merely supplement his knowledge in a small way. One advantage of the present invention is that above and beyond the music that one can produce from a conventional string instrument until now, it adds possibilities that enrich the music and allow the guitarist performance independence, something not known until today, while granting him pleasure and satisfaction by producing richer and more sophisticated music.

BACKGROUND OF THE INVENTION

The body of a conventional, acoustic or electric guitar can have various shapes, but it primarily consists of a sound box, a neck, a fretboard and strings. The strings are removably attached to a "bridge" mounted on the sound box and stretched over the fretboard to the end of the neck where they are attached to tuning keys, one for each string, which provide a convenient method of tuning the strings or replacing them as needed.

String instruments, such as the guitar, have a long history of modifications and improvements and more recently, have undergone changes incorporating modern digital and electronic technology utilizing MIDI (Musical Instrument Digital Interface) protocol.

The following patents are representative of the present state of the art with respect to the present invention:

1) U.S. Pat. No. 6,583,632 to Von Basse et at discloses a grid of capacitor surfaces in an operational amplifier circuit which can be used as a fingerprint sensor. It establishes only the electronics associated with capacitive fret sensors and there is no disclosure of a musical system.
2) U.S. Pat. No. 4,336,734 to Polson discloses a musical instrument structured as a guitar incorporating electronic circuitry to synthesize musical tones. Touch sensitive (capacitive) fret sensors are mounted at addresses corresponding to fret and string locations.

3) U.S. Pat. No. 6,753,466 to Lee discloses an electronic programmable system including a membrane switch chord board which senses finger depression to activate an electronic circuit. The programmable system retrieves programmed notes or chords from a software module and maintenance of the finger pressure maintains the sound of a chord.
4) U.S. Pat. No. 7,541,536 to Daniel discloses a portable multi-sound effect system for processing the electrical audio signals created by a guitar. A touch-sensitive dynamic control unit is mounted upon the front panel of the guitar's body.
5) U.S. Pat. No. 7,812,244 to Kotton et at discloses a method and system for producing synthesizer and MIDI control data for reproducing a signal from data collected by fret sensors coupled to a string instrument which sense the performer's playing and actions on the instrument.
6) U.S. Pat. No. 7,897,866 to Sullivan discloses systems and method for detecting a finger position on the playing surface of an instrument, using a sensor module located at a selected location of the playing surface. The sensor module emits light that is reflected or diffused by a finger near the selected location.
7) U.S. Pat. No. 5,025,703 to Iba et at discloses an electronic string instrument employing a plurality of fret sensors for instrument performance. The fret sensors include apparatus for detecting a fret operation position on a fingerboard with this information being used for various control function including musical tone generation.
8) U.S. Pat. No. 5,033,353 to Fala et at discloses an improvement in detectors using ultrasonic signals to detect fingering on the frets of a guitar or the like, to minimize interference between fret detection and note triggering functions.
9) U.S. Pat. No. 5,990,405 to Auten et at discloses a system for simulating participation in a concert by playing a musical instrument and wearing a head-mounted 3D display including stereo speakers, so that pre-recorded portion of a concert can be presented along with actual playing of the musical instrument.
10) U.S. Pat. No. 6,191,350 to Okulov discloses a guitar adapted for used with a battery power source and having a CPU and memory including preprogrammed chords and melodies. The vibration of the strings is picked up by piezoelectric elements and amplified.
11) U.S. Pat. No. 5,166,467 discloses a foot pedal operating an electronic synthesizer connected to a guitar. The player must thus coordinate the playing of the guitar with his hand and producing chords with his foot.
12) U.S. Pat. No. 5,880,393 relates to a controller for use with a music sequencer in generating musical chords. This prior-art patent illustrates and also claims the invention when applied to an accordion. The system disclosed in this patent although suitable for key operated instruments is not very applicable to string instruments, such as a guitar.
13) U.S. Pat. No. 7,541,536 claims a multi-sound effect system for an amplified guitar. This system does not apply to chord accompaniment.
14) US Patent Application 2003/0210809 A1 discloses an improvement in a sensor for detecting contact with a human finger, without discharging the capacitors via the human finger, thereby avoiding the uncomfortable sensation associated therewith. There is no disclosure of a musical system and therefore this patent is not relevant to the invention, but establishes only the electronics associated with capacitive fret sensors.
15) US Patent Application 2008/0236374 to Kramer discloses an electronic system to generate music-related data based on capacitive sensed inputs from the proximity of the fingers of a player to an array of capacitive fret sensors, which provides sense position information related to the finger depression on a guitar. Capacitance is measured between the fingers of a player and the array of capacitors.

16) PCT Patent Application WO 95/01632 to Hackler discloses an electric guitar, having pressure sensitive apparatus disposed on the neck providing a control signal in response to manual squeezing of the pressure sensitive apparatus.

SUMMARY OF THE INVENTION

The present invention provides the guitarist with an independent computerized chord generating system in accordance with the chords played by the guitarist. Thus the guitarist normally plays a tune with his right hand (if right handed) and generates accompanying chords by pressing and changing the position of his fingers of the left hand. The output of this playing is amplified as is. The left hand movements that generate the chords are electronically captured and the signal thus produced is transferred to a music generating output system.

Thus, in accordance with this invention there is provided an electric, string instrument, such as a guitar, which maintains the original sound and manner of playing without affecting the general look, feel or relative weight of the electric, string instrument, or the familiar manner of playing.

Another object of the present invention is to provide an electric string instrument, such as a guitar, in communication with a computer through a user interface. This user interface can be foot pedals, a touch screen, a keyboard, or any combination thereof. However foot pedals are generally preferred since they do not require the use of a playing hand that needs to be free for strumming or plucking the strings.

Accordingly, it is a principal object of the present invention to provide an electric, string instrument having:

a body with a sound hole;

a neck extending from the body;

a plurality of strings mounted over said neck and sound hole;

a plurality of sensors mounted under the strings along the neck; and electronic circuitry associated with the sensors;

characterized, in that the sensors comprise dynamic, individual fret-activated sensors, each of which is positioned correspondingly under one of the plurality of strings, whereby when a chord is played on the strings of the string instrument, applied finger pressure on the strings activates the corresponding dynamic, individual fret-activated sensors, and transmits the pressure data, representing the played chord, via the electronic circuitry, to a processor to produce an audio output comprising the played chord.

The dynamic, individual fret-activated sensors are disposed on the neck, under the strings. These sensors are preferably capacitance sensors, but induction sensors can also be used. Their detailed construction will be described hereinafter.

A dynamic, individual fret is mounted on the dynamic, individual fret-activated fret sensor as by welding or gluing. When the fingers depress or strum the strings, the dynamic, individual frets are pressed which activate the dynamic, individual fret-activated sensors. This generates an electrical signal which, when transmitted to a processor, is processed to identify and measure the pressure data and related parameters of the finger motions of a player. Accordingly, the automated system is activated to provide preprogrammed chords as musical accompaniment harmonized with the acoustic sounds of the guitar.

The same concept of the present invention can also be applied to other musical instruments and not necessarily only string instruments. For example, a guitar without the strings may also function as a "one-man-band" when constituted with the components of the present invention and played in accordance with the method thereof.

It is important to note that the original sound of the guitar remains, even when the automated accompaniment is working in order to preserve the special effects prevalent in different forms of playing, such as slides in chords, or wha-wha. In addition there is the possibility to raise or lower the automated accompaniment as well as the original sound to adjust them to achieve a proper balance between them.

The musical output system is operated with a computer which is attached to the electric, string instrument by a cable or by a wireless system. Thus, someone who wishes to use the electric, string instrument in the regular way just need not attach it to a computer, only to an audio output.

Another object of the invention is to provide a system whereby one man playing a string instrument can perform like a complete band with musical accompaniment. The system comprises a string instrument with a fret-activated sensor system as defined above with analog-to-digital conversion capabilities; a user interface, for selectively introducing musical accompaniment into system; a MIDI interface, for processing of the digital signals received from both the fret-activated sensor system and user interface and transmitted by MIDI protocol channels; and a synthesizer module connected by MIDI protocol to produce the audio output, the entire process controlled by computer.

The user interface may be a keyboard or foot pedal for use in solo performances (one-man-band), that can provide the input for automated accompaniment (for example: change of sounds, split, transposition, programming, harmonizing, vocalization, tempo, introduction, conclusion, etc.).

The electric, string instrument, of the present invention, for instance, a guitar, is produced in a variety of configurations so as to be usable at different levels of ability, just like organs. Thus, there are provided guitars suitably configured for use by beginners; by amateurs who want to enrich their musical experience; and by advanced players and professional musicians who appear solo or with a group. Alternatively, any simple guitar can be retrofitted to convert it into a one-man band guitar in accordance with the principles of the present invention. Therefore the present invention is suitable for use in all guitar markets, such as electric, classic, and acoustic guitars, and for similar types of string instruments in general.

A MIDI interface is provided with several keys and a display screen (not shown) so that the user will be able to adjust the pressure necessary with respect of the time and speed a key is pressed. If the a key, for example, is pressed for a short duration, the display screen would indicate one kind of response from that key, whereas a longer duration of pressure on the same key would indicate to the MIDI interface 24 that another kind of response is intended. Different intervals (timing or beat) between pressing keys also affects the musical response. These responses are pre-programmed to reflect the taste and choices of musical outcomes desired by the player for a particular playing session and allow great flexibility in programming.

Most string instruments, such as guitars, are provided with a fret board generally divided into fret sections and separated by fixed frets that extend across all the strings of the guitar, whereas in the present invention, dynamic frets are individual, movable segments that operate independently of one another. Fret-activated sensors for identifying changes in pressure are positioned under each of the dynamic frets in a preferred embodiment of the present invention. Fret sensors are characterized as very thin components, being about 0.6 mm or less in thickness.

On the neck of typical guitars, there are about 18 fret sections and the height of the frets, i.e., between the strings, tapers from the end of the neck toward the bridge, depending on the type of guitar and its manufacturer. If, for example, a guitar has six strings and 18 fret sections there should be about (18×6) 108 fret sensor locations. Obviously, not all of them can be pressed at the same time. The present invention elegantly solves this problem.

One does not need a fret sensor, on each fret space. It is sufficient to place fret sensors, such as provided by the present invention, on nine fret sections, which cuts the amount of fret sensors needed in half.

There are chords (full chords) where the index finger presses on all the strings on a fret space and three fingers (middle, ring and pinky) press on the strings on a different fret space. In this situation each string is pressed by the fingers of a player on more than one spot (but not on the same fret space).

There are several known technologies available to identify the finger pressure and other related data. Among these are the inductive and capacitive systems. The specific construction and placement of fret activated sensors and method of use constitute the essence of the present invention. Both systems can work with fret activated sensors which are mounted under dynamic frets and effect a change in their electrical properties when activated.

The installation of the fret activated sensors is such that they do not interfere with the freedom of the player's hand and there is little or no interference with the original sound of the string instrument, such as a guitar, since there is almost no noticeable difference in acoustics with the slight mechanical operation of minute dynamic frets 32 that are placed in proximity to fret sections.

In a preferred embodiment of the present invention, processors (not shown) are connected to each other via a MIDI communications channel, but it is possible to use UART, at TTL levels, with a coated or twisted wire in order to connect to MIDI interface 24.

There are two possibilities for identifying the player's pressure: the player's finger touching the dynamic frets directly or the strings which press on the dynamic frets. Sensing this enables identifying the pressure applied by a player and determining which data is to be transmitted via MIDI communications channel. Since there are two possibilities, the fret sensors need to identify not only pressure data, but also finger location and other related parameters which may be needed in order to communicate an appropriate signal to the system for getting a desired response.

The MIDI protocol includes a synchronous heading; two bytes for each of the strings, the first byte specifying the individual, dynamic fret that is pressed and the second byte giving additional information regarding the pressure. At the end there will appear a sum check of bytes. This requires a communication tempo of 115200 bytes per second.

Other features and advantages of the present invention will become apparent from the drawings and the description given below.

BRIEF DESCRIPTION OF THE DRAWINGS

For a better understanding of the invention with regard to the embodiments thereof, reference is made to the accompanying drawings in which.

DETAILED DESCRIPTION OF THE PREFERRED EMBODIMENTS

Figure 1:
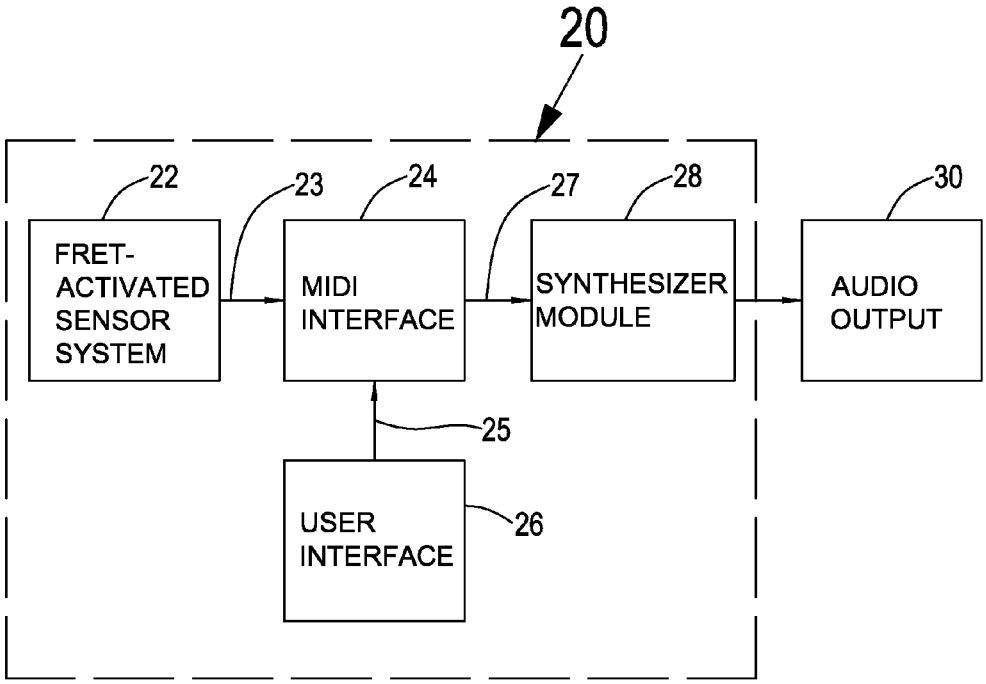
FIG. 1 is a block diagram of a preferred embodiment of the electronic system for the electric, string instrument of the present invention.

Referring now to FIG. 1, there is shown a block diagram of a preferred embodiment of the electronic system of the electric, string instrument of the present invention. The system 20 generally comprises four components: a dynamic, individual fret-activated sensor system 22 that includes with analog-to-digital conversion capabilities; a user interface 26 for selectively introducing input for musical accompaniment into system 20; a MIDI interface 24 for processing of digital signals received from both the dynamic, individual fret-activated sensor system 22 and a user interface 26, which is transmitted by MIDI protocol through channels 23,25 over cables or by wireless transmission, as is known to those skilled in the art; and a synthesizer module 28 connected by MIDI protocol to produce the audio output 30.

At least one processor (not shown), either in the fret-activated sensor system 22, or alternatively, in MIDI interface 24 itself, convert the analog pressure data into digital data which can easily be transmitted by a MIDI communications channel shared between components of system 20, as described above.

The fret-activated sensor system 22 is used for identifying a player's finger pressure, location and duration of such pressure on a plurality of the strings 38 (FIGS. 2A, 2B) of a string instrument, such as a guitar.

The use of a user interface 26, is a preferred embodiment of the present invention. User interface 26, in accordance with the present invention, comprises an array of programmable activation keys on a keyboard console or touch screen (not shown) enabling player interaction with the electronic system. Alternatively, a foot pedal (not shown) is used for foot-activation of switches for the electronic system so as to free the hands and fingers of the guitar player. The pressure on a key or foot pedal is transferred via a MIDI channel 25 to a MIDI interface 24 (FIG. 1). Alternatively, user interface 26 may comprise a standard organ, or a touch screen connected to a PC or even a keyboard, with or without foot pedals. The musical accompaniment can be that of various types of instruments, not only from string instruments. These may be pre-recorded or downloaded from the PC in digital format for harmonizing with the acoustical sounds of the guitar, which has been adapted with the dynamic, individual fret-activated sensors of system 20.

MIDI interface 24 processes the digital signals received from both the fret-activated sensor system 20 and the user interface 26 through MIDI protocol transmission channels 23 and 25, respectively, and feeds this data via another MIDI protocol channel 27 to a synthesizer module 28 where it is further processed and transmitted to an audio output 30. Audio output 30 may be any combination of musical acoustics, including that produced from playing the stringed musical instrument (see FIG. 2A), or from sounds from musical accompaniment selectively introduced by a player through operation of user interface 26 while playing the string instrument solo. The synthesizer module 28 adds synthesized chords of a variety of musical instruments to give the effect at the audio output 30 of a performance of a whole band, in effect being a one-man-band. A MIDI interface 24 receives the raw information of the player's finger pressure as they are defined previously, including identifying whether a chord was pressed, and if the length of time of the pressure is valid. If the pressure meets both these criteria, it will be transmitted by the MIDI channel 23 to the MIDI interface 24.

MIDI interface 24 has an external power supply (not shown) which will feed the guitar, at least one processor that will receive the information from the guitar and identify a chord in MIDI and simultaneously receive the MIDI information from a user interface 26, such as a foot pedal or key or touch screen and combine the acoustic sound of the guitar with musical accompaniment from the user interface 26 which are processes by MIDI interface 24 and communicated to a synthesizer module 28 to produce an audio output 30.

Synthesizer module 28 can be an electronic synthesizer, an organ with a MIDI entrance, a computer program, a MIDI module as part of a computer processing unit (CPU), or other music sequencer which supports the MIDI protocol, as is known by those skilled in the prior art.

Synthesizer module 28 receives digital signals from MIDI interface 24 via a MIDI protocol channel 27, including the acoustic sound of the string instrument being played and selected musical accompaniment input into system 20 by the musician-player from operating the user interface 26. The synthesizer module 28 is programmable for integration and processing of the musical accompaniment with the sounds from the string instrument to produce (arrow) audio output 30.

Figure 2A:
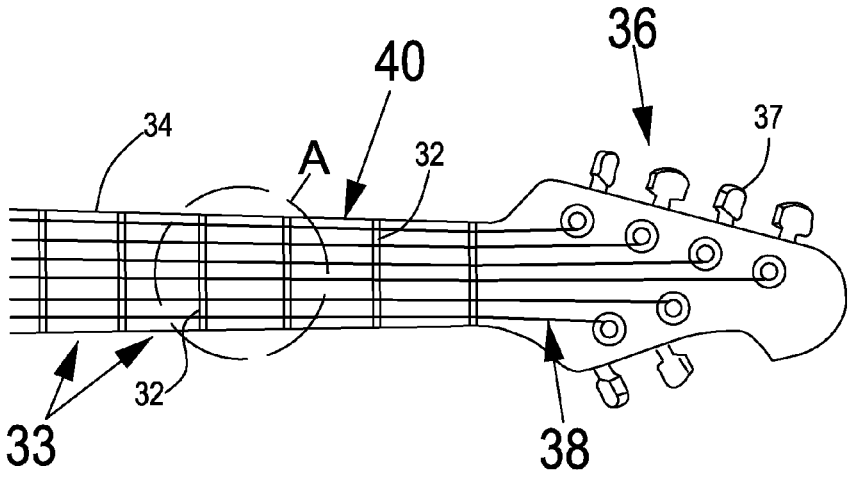
FIGS. 2A and 2B show a general, top view and an enlarged, schematic view, respectively, of a guitar neck adapted in accordance with a preferred embodiment of the present invention.

Synthesizer module 28 produces sounds according to the instructions of the player, whether from an activated key on a keyboard, from a foot pedal, or from a fret activated sensor (see item 42, FIG. 2C or item 56, FIG. 3B) on neck 34 of the guitar (see FIG. 2A).

There are several available, off-the-shelf products that can be used but it is desirable to integrate the hardware and software and to obtain a PC which will serve as synthesizer module 28 and organize the information from all the components of the system. For the present invention, only a basic computer is needed, there is no need for a sophisticated computer, only a MIDI and a quality audio adapter as is known to those skilled in the art, as reference to sources on the Internet will readily show suitable, referenced off-the-shelf components for use with the present invention.

If a display screen is used for user input and programming of the synthesizer module 28, it should, preferably, be a "touch" screen, and preferably a small screen on an adjustable stand for the sake of economy and user friendliness. A PC or a component especially designed for this function, as is known by those skilled in the art, can be placed at the bottom of the stand. It is also recommended to have an anchor for a pedal around the base of the playing instrument. The unit may be collapsible, and convert to a trolley when folded for convenient transport or movement from place to place on a platform or stage.

An organ (not shown) is a standard musical instrument, several of which have MIDI inlets. Since the MIDI protocol is standard, it can be connected to an organ so that the guitar and a pedal will be a part of the organ interface. The advantage is that they are ready to use and have known results. The disadvantage is their size, and inflexible programming.

Synthesizer module 28 includes everything necessary to produce music from the MIDI systems; it is ready to use, with known results.

A computer having the appropriate program will give the maximum necessary flexibility for the production of sounds, and will especially enable the creation of the series of necessary tasks to make the system of the invention perform well. A major advantage of this system is that it allows for maximum flexibility in programming.

The ability to produce sounds is solely dependent on the synthesizer module 28 selected, as is known by those skilled in the prior art. In effect, implementation of the music will be limited by the executions of the kind of synthesizer chosen and the level and choice of sounds and their execution that it offers.

Figure 2B:
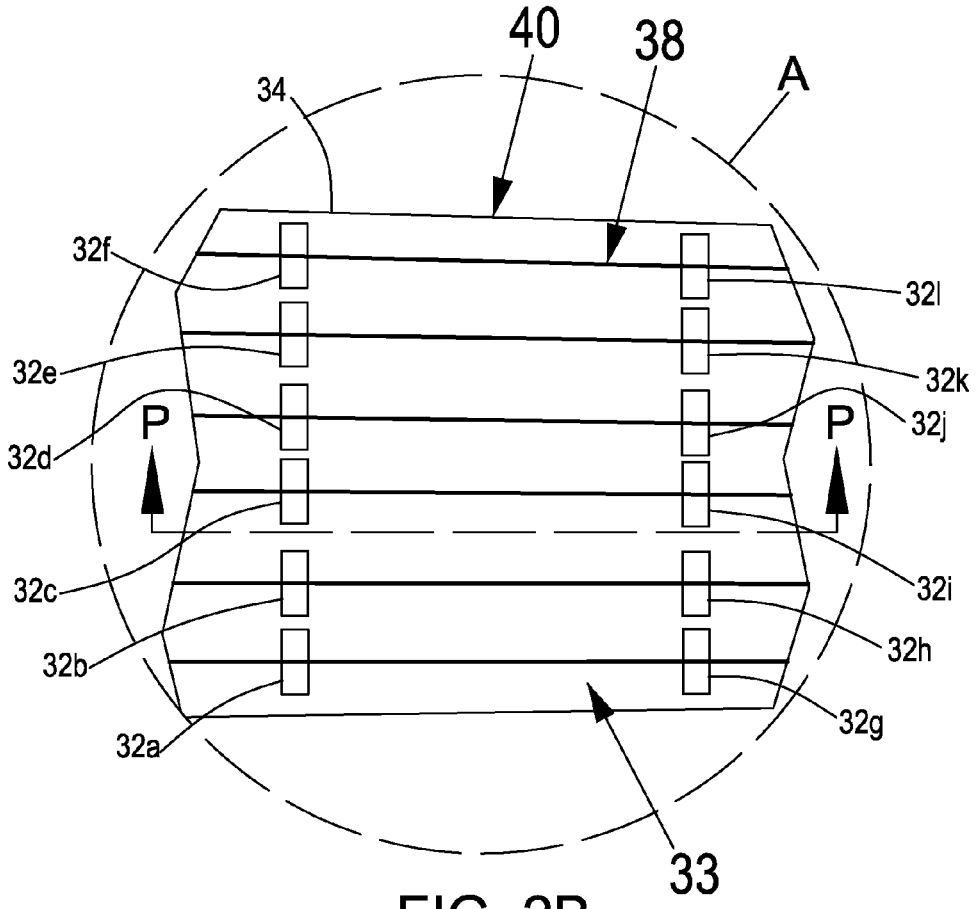

In FIGS. 2A and 2B there are shown a general top view and an enlarged, schematic view, respectively, of a portion of a guitar neck 34 adapted in accordance with a preferred embodiment of the present invention.

A portion of a typical guitar neck 34 is shown with six strings 38 stretched along its length, by way of example. Some string instruments may have fewer or more strings. Under each of the plurality of strings 38 are shown a corresponding plurality of dynamic, individual frets 32*a-l* (see FIG. 2B). As better seen in FIGS. 2C, 2D and 2E, there are illustrated views of the construction and operation of dynamic, individual frets 32 and dynamic, individual fret sensors 42.

Referring now to FIG. 2A in detail, there is shown a general, top view of a portion of a guitar neck 34 modified, by way of example, in accordance with the principles of the present invention in a preferred embodiment thereof.

Neck 34 is shown divided into fret sections 33 by individual, dynamic fret activated sensors 32 arranged in rows across the width of the neck 34 as in typical guitars. Strings 38, usually six or more, are stretched tautly from a lower body part (not shown) to the head 36 where they are removably anchored to a set of tuning pegs 37 used for adjusting the tension in the strings 38 or for replacing them as needed.

FIG. 2B is an enlarged, schematic view of Detail A from FIG. 2A showing a top view of two rows of individual, dynamic frets 32*a*-32*l* disposed beneath the strings of a guitar in accordance with a preferred embodiment of the present invention.

The fret sensor system 22 (see FIG. 1) for sensing and identifying the player's finger pressure and other related data is mounted on neck 34. The data collected by the dynamic, individual fret activated sensors 42 (see FIG. 2C) is transferred in an analog or digital manner to MIDI interface 26 (see FIG. 1) for processing. Depressing or strumming a string 38 is immediately identifiable by individual fret activated sensors 42 underlying corresponding strings 38. The guitar strings 38 are non-conducting to avoid conflict with the electronics in fret sensor system 22 (see FIG. 1). Pressing a particular dynamic individual fret 32 activates a corresponding individual fret-activated sensor 42. The output is enhanced by a player through a user interface 26 which is used to call up selected chords and musical accompaniment to harmonize with the acoustic sound of the guitar.

Fret-activated sensor system 22 (FIG. 1) is designed to have a minimal profile and not interfere with the playing. The connection between dynamic, individual frets 32 in fret section 33 is a linear rapid channel, since there are chords that spread over more than just one fret section 33. It would appear that the recall of the pressed chord can best be achieved via a separate processor (not shown) that gathers the information from the dynamic, individual fret sensors 42 in each of the relevant fret sections 33 so actuated and identifies the finger motion and pressure of the player on the plurality of strings 38 to produce a specific chord.

Detail A shows two adjacent rows of individual frets 32*a-f* and frets 32*g* to 32*l* forming a fret section 33 between them where a player can pluck or strum the strings 38. Beneath the individual, dynamic, individual frets 32*a-l* are fret activated dynamic, individual fret sensors 42 (see FIG. 2C). Alternatively, dynamic, individual fret sensors 56 (see FIG. 3B) can detect and identify the finger movement of a player and finger pressure dynamics to call up preprogrammed or selected chords to accompany the acoustic sounds from the guitar itself.

Further details are shown and described hereinafter in respect to cross-section P-P (see FIG. 2C).

Figure 2C:
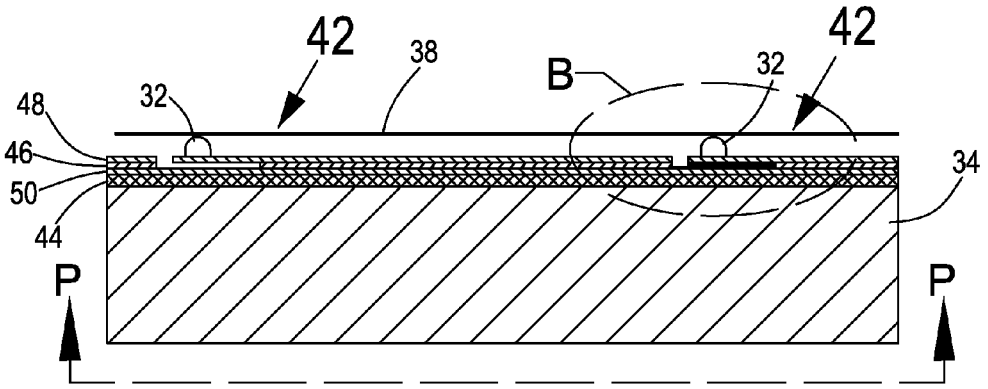
FIG. 2C is a cross-sectional view P-P from FIG. 2B showing the disposition of fret sensors mounted on a printed circuit board (PCB) in accordance with an embodiment of the present invention.
Figure 2D:
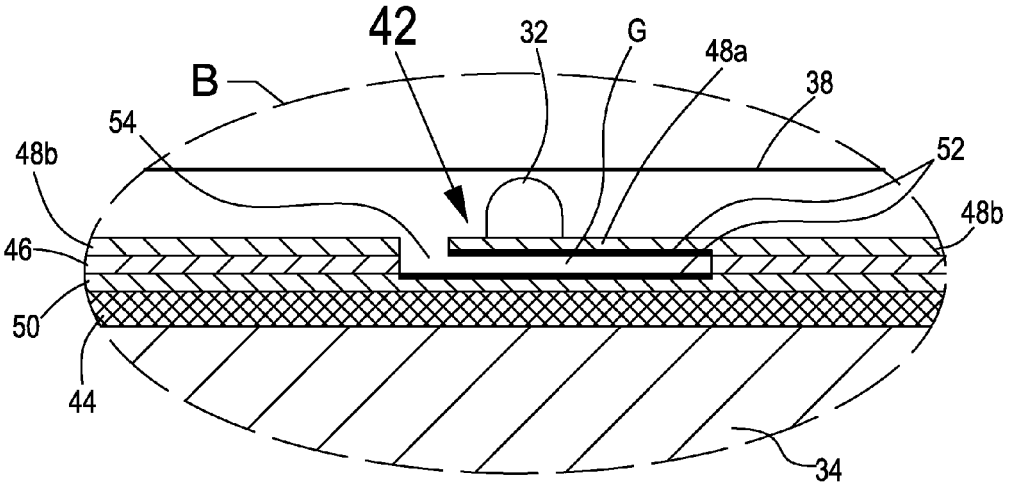
FIG. 2D is an enlarged view, Detail B from FIG. 2C showing the fret sensor in an un-activated orientation.
Figure 2E:
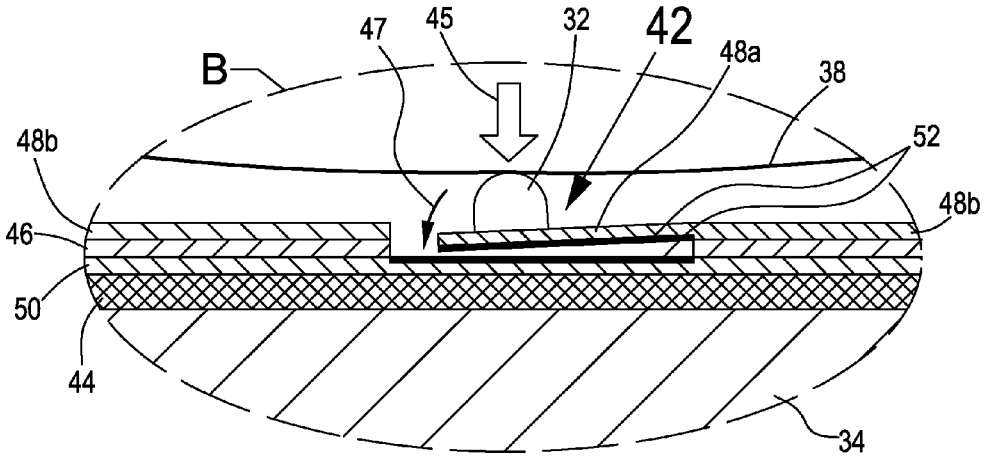
FIG. 2E is another enlarged view, Detail B from FIG. 2C showing the fret sensor in an activated orientation.

FIGS. 2C, 2D and 2E illustrate a neck section 34, not to scale, which comprises a PCB (printed circuit board) 44 on top of which is mounted a plurality of dynamic, individual fret activated fret-sensors 42, each comprising a very thin lower conducting layer 50 separated by a layer of insulation 52 from a very thin upper conducting layer 48*a*, with the activating individual fret 32 attached to the upper conducting layer 48*a*, constituting a capacitor type fret-activated sensor 42.

Referring now to FIG. 2C, there is shown a cross-sectional view P-P from FIG. 2B showing the disposition of the individual fret activated fret sensors 42 mounted on a guitar neck 34 in accordance with a preferred embodiment of the present invention. PCB 44 is attached to the neck 34 in place of a standard fretboard (not shown) and configured with a plurality of individual bending fret activated sensors 42 disposed under and attached to individual, dynamic frets 32. Only a tiny portion 48*a* of the upper conducting layer 48*a* actually bends. The majority of the upper conducting layer 48*b* is fixedly attached to insulator 46 which separates upper conducting layer 48*a/b* and lower conducting layer 50.

Further details are described in relation to Detail B shown in an enlarged view in FIG. 2D.

FIG. 2D is an enlarged view of Detail B from FIG. 2C showing a cross-sectional view of the disposition of the upper and lower conducting layers 50 and 48*a*, respectively in a typical individual fret sensor 42 in one embodiment of the present invention. Independent, dynamic fret 32 is shown attached to upper conducting layer 48*a* of fret sensor 42. Note that the facing surfaces of upper conducting layer 48*a* and lower fixed plate 50 are coated with a very thin coating 52 of insulation. Gap G is shown as an L-shaped air gap, but suitable compressible dielectric material may be used to fill the space and maintain a tiny separation between upper bendable conducting layer 48*a* and lower fixed layer 50. Upper conducting layer 48*a* does fully meet upper conducting layer 48*b* as a very small separation 54 is maintained between them to avoid inadvertent contact with the rest of the fixed layers of material comprising a portion of upper conducting layer 48*b*, an insulation layer 50, and a lower conducting layer 50 all mounted on a PCB 44. Guitar strings 38 are shown stretched above the dynamic, individual frets 32 (see FIG. 2D) so that finger pressure on strings 38 depresses correspondingly, the dynamic, individual fret 32 and consequently actuates bending individual fret sensor 42 (see FIG. 2E for details).

FIG. 2E is another enlarged view of Detail B from FIG. 2C showing the bending motion of a bending upper conducting layer 48*a* in bending fret sensor 42 when downward finger pressure is applied to it. An individual, dynamic fret 32 is shown attached to upper conducting layer 48*a*. When finger pressure of a player (arrow 45) depresses a string 38 over individual, dynamic frets 32, the action (arrow 47) causes upper conducting layer 48*a* to bend toward lower conducting layer 50 in a few tenths of a millimeter in a small arc 47 (arrow) thereby reducing the gap G and increasing the capacitance value between upper and lower conducting layers 48,50.

This increase in capacitance can be measured in several ways such as: measuring the frequency changes, measuring the voltage changes, or measuring the charging time. Each dynamic, individual fret activated sensor 42 changes its capacitance value according to the pressure applied to its corresponding dynamic fret 32. The capacitance value of every fret section, fret sensor 42 is transferred to a microprocessor (not shown) for further processing.

One of the abovementioned micro-processor's processing functions comprises the ability to recognize if the guitar player is simultaneously pressing at least two fret sections (i.e., at least a two-notes chord) in a predefined pressure as this is necessary to establish a signal to call up at least one melodic chord to accompany the acoustic sounds made by playing a guitar.

Figure 3A:
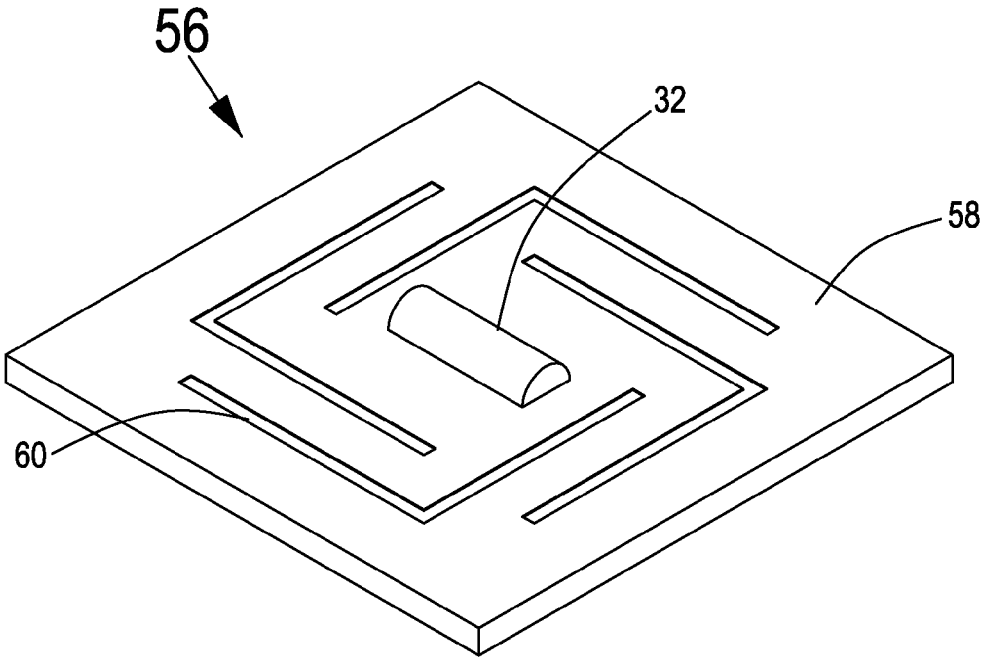
FIGS. 3A and 3B show a perspective view and a top view, respectively, of another embodiment of a typical fret sensor of the present invention.
Figure 3B:
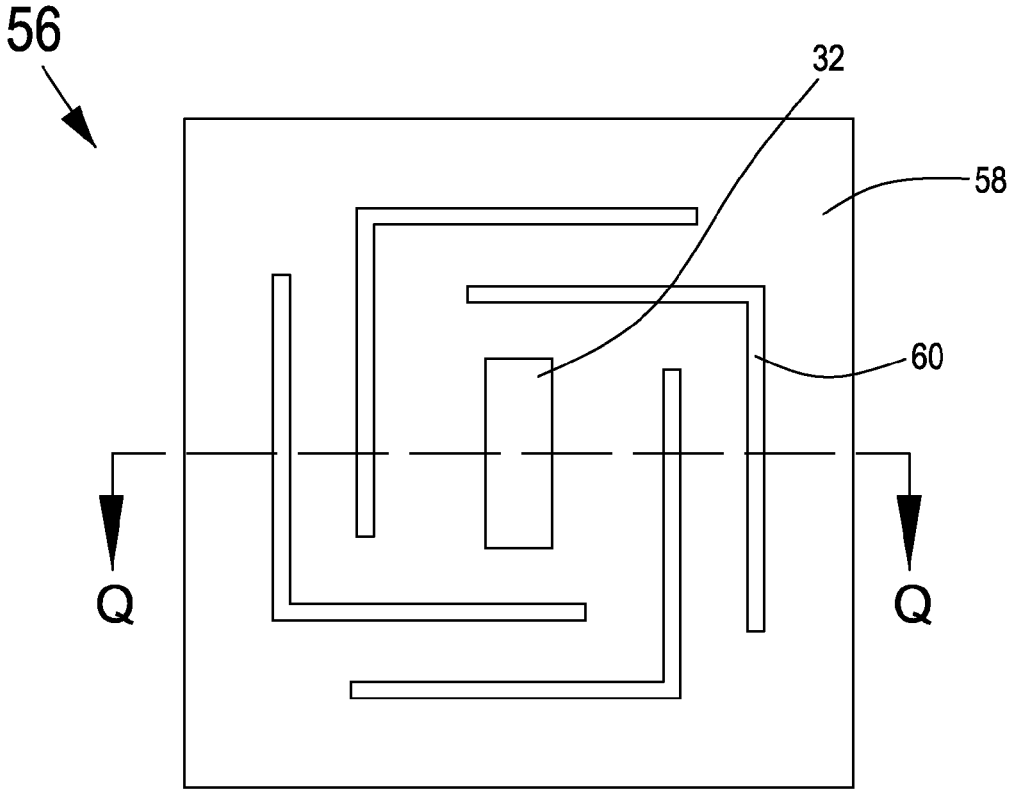
Figure 3C:
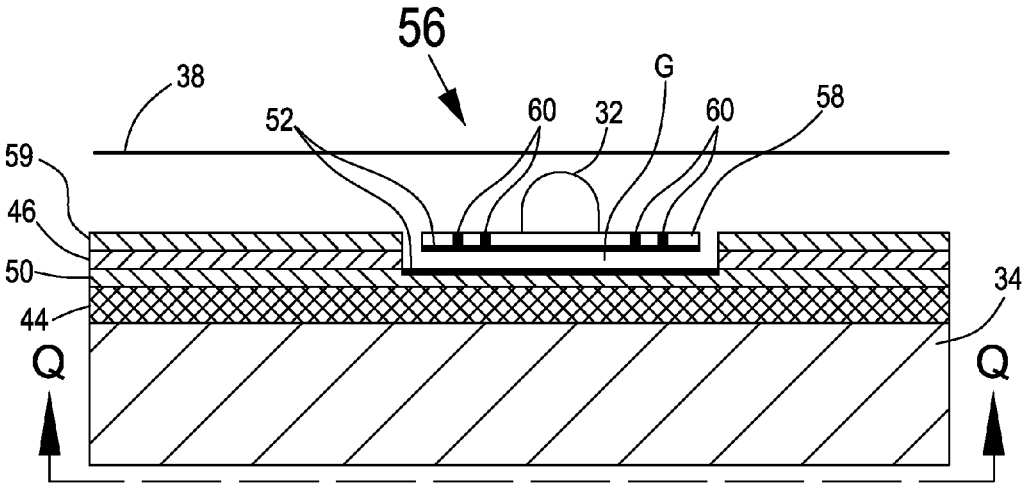
FIG. 3C is a cross-sectional view Q-Q of the embodiment shown in FIG. 3B in an un-activated orientation.
Figure 3D:
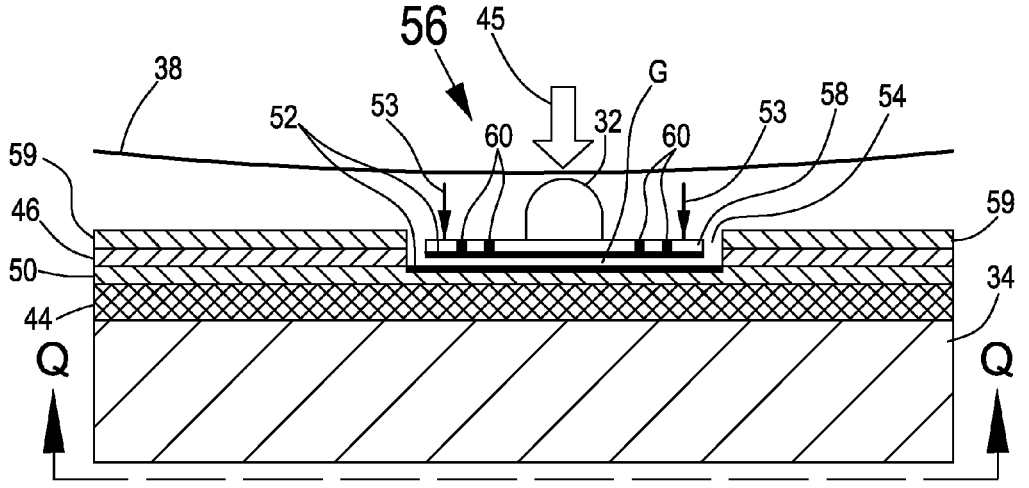
FIG. 3D is a cross-sectional view Q-Q from FIG. 3B showing the fret sensor in an activated orientation.

FIGS. 3A and 3B show a perspective view and a top view, respectively, of another embodiment of a typical fret sensor of the present invention., and FIGS. 3C and 3D show enlarged, cross-sectional views Q-Q from FIG. 3B. Sensor 56 is seen with an individual, dynamic fret 32 mounted on a "floating", upper conducting layer 58. The appearance of floating is the result of the freedom of upper conducting layer 58 to be almost uniformly pressed downward towards lower conducting layer 50 (FIG. 3C, 3D) instead of being bent as shown in FIG. 2C.

A series of four, L-shaped grooves 60 are embossed in a geometric pattern around dynamic fret 32 in order to facilitate some small floating stability when upper conducting layer 58 has pressure applied to it from dynamic fret 32 being pressed downward. The L-shaped grooves 60 act to prevent unwanted lateral distortion, and the surface with the grooves 60 tends to pop back up when upper conducting layer 58 is relieved of pressure and the grooves 60 can return to their normal position.

Referring in detail to FIG. 3C there is shown a floating fret sensor 56 provided with a dynamic upper conducting layer 58 and a lower conducting layer 50 separated by a dielectric 52. Floating fret sensor 56 is shown in an inactivated state with the upper and lower conducting layers 58, 50, respectively, being at the maximum distance in height from one another.

FIG. 3D is very similar in many features to those described and shown in FIG. 2E, with the exception of having a bending fret sensor 42 in the latter drawing and a floating fret sensor 56 in the former, respectively. When pressure 45 (arrow) is applied to a dynamic fret 32 by depressing one or more guitar strings 38, the upper conducting layer 58 is forced downward as shown by action arrows 53. The change in distance between the two layers 58, 50 generates a capacitance. This information is transmitted to a processor (not shown) which after processing by an electronic system, produces a musical chord which can be heard in harmony with the audio output in accordance with input from a user interface 26 where a player can select many kinds of musical accompaniment.

Non-conductive insulation or a dielectric 46 separates the two active layers of fret sensor 56. Each conducting layer 50, 58 is coated with an insulation coating 52 on their facing surfaces.

The changes in capacitance are measured and the data, converted by a processor (not shown) into digital format, is used as input for electronic control and organization in the inventive system (FIG. 1) of the present invention to produce automated, selected musical accompaniment to harmonize with the acoustic output of a guitar played solo.

The description in regard to bending fret sensors 42 in the preferred embodiment of the present invention as given herebefore, discussed capacitance elements, but it should be understood that inductance elements (as described in regard to FIG. 4) may optionally be used to achieve the same purpose in operating the invention as hereinbefore described.

Figure 4:
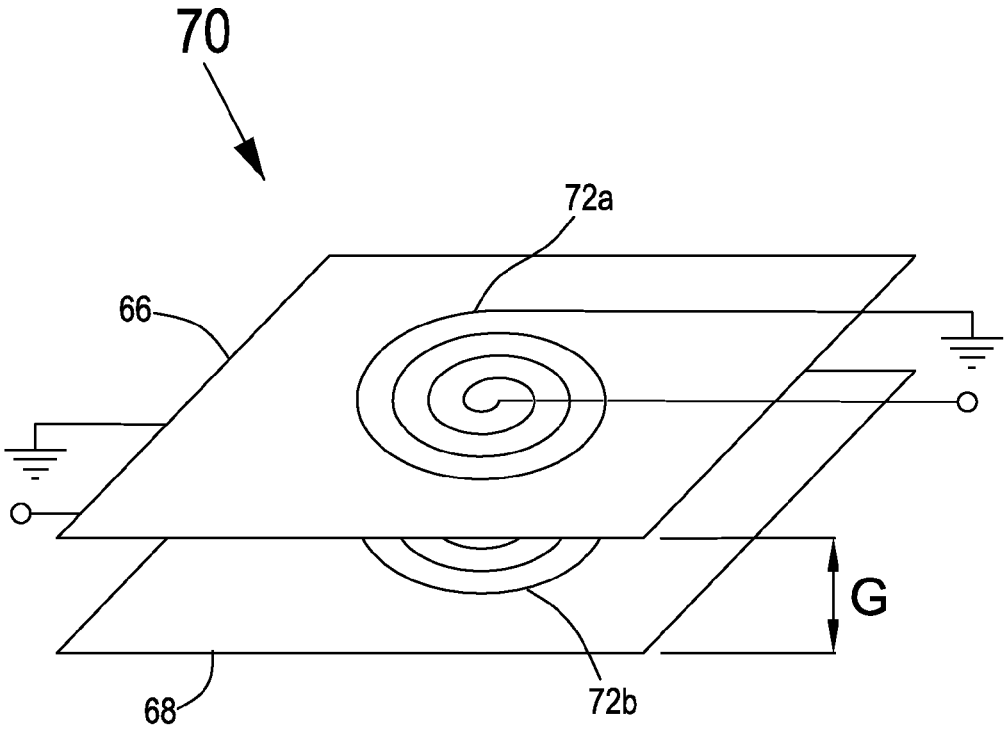
FIG. 4 is a perspective view of a fret sensor configured with inductance coils in accordance with another embodiment of the present invention.

FIG. 4 is a perspective view of a fret sensor configured with inductance coils in accordance with another embodiment of the present invention. Fret sensor 70 is operated utilizing an inductance effect from two electrical coils 72*a* and 72*b*. A right-wound inductance coil 72*a* is embedded in an upper plate 66 whereas a left-wound inductance coil 72*b* is embedded in a lower fixed plate 68 of fret sensor 70, by way of example. The dielectric gap G is altered when an electric field is introduced between coils 72*a/b*. When mounted on a PCB or similar non-conducting platform 44 (FIG. 3C), one wire extending from the center of a coil acts an input and the other end of each coil 72*a/b* is grounded forming a common ground connection to complete the electrical circuit to power inductive type fret sensor 70.

In another embodiment of the present invention, the neck 34 of the electric, string instrument, under the plurality of strings 38, is provided with a programmable touch panel (not shown) which acts as a fret sensor and identifies the touch of the player and the chords played, and translates them into automated accompaniment. This panel is touch-sensitive to the force of the touch and identifies (according to the duration of the pressure) when the musician-guitarist presses a chord and intends for this chord to be played by the automated accompaniment. Also, the chord has to have a duration of at least two notes. All other movement of the fingers on the plurality of strings 38 will not activate the automated accompaniment and will sound and give the feeling of music from a regular electric guitar, with all its bends and slides.

Having described the present invention with regard to certain specific embodiments thereof, it is to be understood that the description is not meant as a limitation, since further modifications may now suggest themselves to those skilled in the art, and it is intended to cover such modifications as fall within the scope of the appended claims.

We claim:

1. A string instrument comprising:

a body with a sound hole;

a neck extending from the body;

a plurality of strings strung over the neck and sound hole;

a plurality of frets positioned under the strings along the neck;

a plurality of sensors selected from capacitance sensors or induction sensors positioned on the neck; and electronic circuitry associated with the sensors;

characterized, in that each of the frets comprises separate individual fret sections each mounted over a corresponding sensor, thereby forming separate individual dynamic fret-activated sensors, and each individual dynamic fret-activated sensor being positioned correspondingly under one of the plurality of strings, wherein the capacitance sensors comprise a fixed lower conducting layer spaced apart and insulated from a displaceable upper conducting layer, there being a dielectric between said layers, said sensors being secured under individual, dynamic fret sections whereby pressure on the dynamic frets displaces the upper layer of the sensors in the direction of the lower layer generating a capacitance proportional to the displacement, and wherein the induction sensors comprise a lower conducting coil spaced apart and insulated from an upper conducting coil having an individual, dynamic fret section secured over said upper conducting coil, whereby, when a chord is played by applying finger pressure on the strings, pressure is applied on the corresponding individual frets activating the individual dynamic fret-activated sensors, which transmit the pressure data representing the played chord, via the electronic circuitry to a processor to produce an audio output comprising the played chord.

2. A string instrument as claimed in claim 1, wherein the individual fret sections are mounted on the sensors by welding or gluing.

3. The string instrument as claimed in claim 1, wherein said plurality of strings comprises a series of non-conductive musical strings.

4. A string instrument as claimed in claim 1, wherein the electronic circuitry is provided by a PCB.

5. A string instrument as claimed in claim 4, wherein said PCB with the conducting layers have a thickness between 0.1 mm to 0.6 mm.

6. An instrument as claimed in claim 4, wherein said PCB with the conducting layers have a thickness of 0.2 mm.

7. A string instrument as claimed in claim 1, comprising a guitar.

8. A string instrument as claimed in claim 7, selected from electric, classical and acoustic guitars.

9. A string instrument as claimed in claim 1, further including pickups that enable amplification of the played sound.

10. The string instrument as claimed in claim 1, wherein the pressure data comprises at least one of the parameters selected from the group consisting of: finger movement, finger location, pressure, pressure and speed of a player's fingers on at least one of said plurality of strings, and combination thereof.

11. A system for producing music from a string instrument with musical accompaniment by a solo player, comprising; a string instrument in accordance with claim 1, the electronic circuitry including: a user interface for input and control of selected musical accompaniment, a MIDI interface for integration and processing said selected musical accompaniment with the acoustical sounds from said electric string instrument, and a synthesizer module to produce an integrated audio output.

12. A method for producing acoustic sounds and selected musical accompaniment with a string instrument played solo, said method comprising, providing:

a) a string instrument in accordance with claim 1, b) a user interface for input and control of selected musical accompaniment, c) a MIDI interface for integration and processing said selected musical accompaniment with the acoustical sounds from said electric, string instrument, d) a synthesizer module to produce an integrated audio output, said method consisting of the steps:

1) playing the instrument by exerting finger pressure on the strings, thereby activating the individual dynamic, fret-activated sensors,
2) detecting, identifying and measuring parameters of pressure data from finger pressure applied to the strings via the individual dynamic fret-activated sensors;
3) converting said parameters from analog-to-digital signals;
4) controlling selected input of musical accompaniment with the user interface, to complement the acoustic sounds, including chords, of the played electric, string instrument;
5) producing an audio output comprising acoustical effects produced from playing on said electric, string instrument harmonized with selected musical accompaniment generated from said user interface with the synthesizer module in communication with output from said MIDI interface.

13. The string instrument as in claim 1, wherein increase of capacitance between the displaceable upper layers and the fixed lower layers is measured by measuring changes in frequency and voltage.

* * * * *